US005427653A

United States Patent [19]

Andersson et al.

[11] Patent Number: 5,427,653

[45] Date of Patent: Jun. 27, 1995

[54] PRESS AND METHOD FOR MODIFYING A PRESS FOR USE IN THE PRESS SECTION OF A PAPERMAKING MACHINE

[75] Inventors: Nils Andersson; Bo-Christer Aberg, both of Halmstad, Sweden

[73] Assignee: Albany Nord skafilt AB, Halmstad, Sweden

[21] Appl. No.: 142,291

[22] PCT Filed: May 22, 1992

[86] PCT No.: PCT/SE92/00344

§ 371 Date: Nov. 18, 1993

§ 102(e) Date: Nov. 18, 1993

[87] PCT Pub. No.: WO92/20858

PCT Pub. Date: Nov. 26, 1992

[30] Foreign Application Priority Data

May 24, 1991 [SE] Sweden ..... 9101576

[51] Int. Cl.[6] ..... D21F 3/02

[52] U.S. Cl. ..... 162/199; 162/205; 162/358.3; 162/358.4; 162/901

[58] Field of Search ..... 162/358.3, 358.4, 358.5, 162/361, 901, 205, 199; 100/153, 154

[56] References Cited

U.S. PATENT DOCUMENTS

| | | | |
|---|---|---|---|
| 3,981,084 | 9/1976 | Sobota | 162/360.2 |
| 4,431,045 | 2/1984 | Josefsson | 162/358 |
| 4,559,258 | 12/1985 | Kiuchi | 162/358.4 |
| 4,564,551 | 1/1986 | Best | 162/901 |
| 4,946,731 | 8/1990 | Dult | 162/901 |
| 5,043,046 | 8/1991 | Laaputti | 162/358.5 |
| 5,175,037 | 12/1992 | Merckens et al. | 162/901 |

FOREIGN PATENT DOCUMENTS

| | | |
|---|---|---|
| 0194602A1 | 9/1986 | European Pat. Off. . |
| 63-247061 | 9/1988 | Japan . |

*Primary Examiner*—Karen M. Hastings

*Attorney, Agent, or Firm*—Kane, Dalsimer, Sullivan, Kurucz, Levy, Eisele & Richard

[57] ABSTRACT

A press is devised for a papermaking machine. The press is of the type having a rotary press roll, a substantially stationary pressure shoe, and a press belt running in an endless path around the pressure shoe between this and the press roll and having a substantially impermeable inner surface facing the pressure shoe. A separate, endless reinforcing belt enclosing the press belt is in frictional engagement over the entire length of the press belt so as to run together in the press belt in the endless path. The reinforcing belt may be prestressed, e.g. by shrinkage, in its running direction and, optionally, also transversally thereof. According to a second aspect, the invention relates to a method of modifying a press of the type indicated above, in which method the press belt is enclosed by a separate, endless reinforcing belt of the above-indicated type.

11 Claims, 2 Drawing Sheets

PRESS AND METHOD FOR MODIFYING A PRESS FOR USE IN THE PRESS SECTION OF A PAPERMAKING MACHINE

BACKGROUND OF THE INVENTION

The present invention relates to a press and a method for modifying a press for use in the press section of a papermaking, cellulose or board manufacturing machine. More specifically, the invention relates to the field of shoe presses, being a type of presses having a press nip extended in the machine direction.

A shoe press generally comprises a rotary press roll, a substantially stationary pressure shoe, and a press belt running in an endless path around the pressure shoe between this and the press roll and having a substantially impermeable inner surface facing the pressure shoe. The pressure surface of the shoe facing the press roll is arcuate by a curvature corresponding to the radius of the press roll. The press nip formed between the press roll and the shoe is intended to receive, between the press roll and the outer side of the press belt, a web, such as a paper web, from which water is to be removed. The water which is pressed out of the paper web by the press is initially taken up by one or more press felts, generally one press felt in the form of a sandwich structure provided on each side of the paper web. In operation, the rotating roll feeds the paper web, the felt or felts, as well as the press belt jointly through the press nip.

The extent of the pressure surface of the shoe in the machine direction may be in the order of 25 cm (10 inches), which is several times longer than the nip in a traditional roll press with two rolls, and (for a given web speed) results in a corresponding increase of the press time. Hence, a shoe press enables considerably enhanced dewatering of the paper web.

In a shoe press, between the shoe and the inner surface of the press belt, there is traditionally provided for friction-reducing oil lubrication by means of an oil film. The oil film is produced by conducting pressurised oil through one or more oil ducts provided in the interior of the shoe and opening at its pressure surface. The press belt serves to maintain the oil film established between the press belt and the shoe in place and, therefore, must be oil-impermeable. In this way, the oil is also prevented from fouling the paper web and the felt or felts.

Another demand placed on the press belt in a shoe press is that the inner surface of the press belt must be smooth to expose a good sliding surface to the shoe. As known in the art, a good sliding surface can be achieved by providing a base weave of the press belt with a layer of plastic, which then also makes the press belt oilproof. Such press belts provided with a plastic layer are known from EP-A-01,194,601 (Albany Int. Corp.), U.S. Pat. No. 4,564,551 (Best), U.S. Pat. No. 4,946,731 (Dutt), U.S. Pat. No. 4,559,258 (Kiuchi), and JP 63-247061 (Ichikawa Umou Co. Ltd).

In addition to the above-mentioned two demands placed on the press belt in a shoe press—oil tightness and a smooth inner sliding surface—the belt must also be strong to have a long service life and be dimensionally stable so as not to be stretched during mounting or in operation. Moreover, the press belt must be given a uniform thickness when manufactured.

To sum up, the following demands are thus placed on a press belt in a shoe press:

1. Oil tightness.
2. Smooth inner sliding surface.
3. Long life.
4. Dimensional stability.
5. Uniform thickness.

Hitherto, it has been difficult to meet all these demands (1–5) on a press belt in a shoe press. Especially, a dimensionally unstable press belt causes problems in shoe presses of the short-belt type, which in the context of this invention means a shoe press which, in addition to the features mentioned above, is distinguished by the press shoe being integrated in the outer periphery of a usually cylindrical, non-rotating element, the outer periphery of which defines the endless path of the press belt. Rotary sealing means are arranged at each end of the cylindrical element in order, together with the running press belt, to retain the oil film in a closed space. As compared with shoe presses of the long-belt type, which lack the above-mentioned non-rotating, cylindrical elements and the rotary sealing means and in which the press belt instead runs about an assembly of separate guide rollers, a short-belt type shoe press is advantageous in that the oil which the press belt draws off from the oil film in the press nip will be retained inside a closed system. In a long-belt type shoe press, special measures must be taken to remove such entrained oil from the press belt and also to collect the removed oil, which makes a shoe press of the long-belt type more complex and expensive.

The reason why dimensional instability of the press belt in particular entails problems in a shoe press of the short-belt type will now be explained.

If the press belt is stretched in the running direction, i.e. circumferentially about said cylindrical element, this may result in an impermissible increase of the diameter of the endless press belt with consequent operational disturbance. Further, manufacturing a press belt of a length exactly corresponding to the diameter of the cylindrical element obviously poses problems. As to the length of the press belt, which traditionally lies within a certain tolerance range, there are two contradictory desiderata. It is desirable, on the one hand, that the press belt is easy to mount and, on the other hand, that when mounted it has no radial play with respect to the cylindrical element about which the press belt runs. The first desideratum is satisfied by means of a press belt which is in the upper part of the tolerance range, whereas the second desideratum is satisfied by means of a press belt which is in the lower part of the tolerance range.

In a shoe press of the short-belt type, the press belt is also stretched transversally of its running direction on the cylindrical element, i.e. in the axial direction thereof, and in addition to the above-mentioned problem of stretching in the circumferential direction, the press belt, also, must not be stretched too much in the axial direction, since axial stretching gives rise to practical problems in the axial tensioning of the press belt when being mounted.

A problem common to shoe presses of both the short-belt type and the long-belt type relates to difficulties in taking care, in the press nip, of the water removed from the paper web. More specifically, it is difficult to provide an open, incompressible volume sufficient for receiving the water from the press felt or felts.

It is known to provide such an incompressible, open water-receiving volume directly in the outer surface of the press belt, i.e. such that the press belt performs the double functions of sealing against the oil film and of taking care of water pressed out of the web to remove it. U.S. Pat. Nos. 4,946,731 and 4,559,258 mentioned above describe press belt structures having a base weave completely enclosed by an impermeable layer of plastic, whose outer surface is formed with substantially incompressible water-receiving grooves. The above-mentioned U.S. Pat. No. 4,564,551 and JP 63-247061 describe press belt structures having a base weave whose inner side is provided with an impermeable layer of plastic and whose outer side has a water-receiving structured surface formed by the base weave itself.

JP 63-247061 also describes the use of a separate dewatering belt in the form of a wire cloth which, in the press nip, runs between the structured outer surface of the press belt and a press felt and which, outside the press nip, runs about separate guide rollers.

SUMMARY OF THE INVENTION

The general object of the present invention is to overcome, or at least substantially reduce the shortcomings of conventional shoe presses as set forth above.

A main object of the invention is to overcome, or at least substantially reduce the problems inherent in conventional shoe presses, especially shoe presses of the short-belt type, and relating to the dimensional instability or stretching of the press belt.

Another object of the invention is to overcome, or at least substantially reduce the problem of taking care of water Dressed out in a shoe press.

A shoe press according to the invention thus has a separate, endless reinforcing belt which is in enclosing frictional engagement with the press belt throughout the entire length thereof. As a result of this frictional engagement, the reinforcing belt according to the invention is caused to run Jointly with the press belt, that is without any relative sliding movement between the reinforcing belt and the press belt, along the entire endless path of the press belt.

By employing such a reinforcing belt, it is possible to eliminate, or at least substantially reduce the problems relating to the dimensional instability of the press belt. Since the reinforcing belt encloses the press belt throughout the entire length thereof, forces applied to the press belt which in conventional shoe presses give rise to undesired stretching of the press belt in the running direction thereof, will be taken up by the reinforcing belt so as to prevent or at least substantially reduce undesired stretching of the press belt in the running direction thereof.

The invention thus tackles the problem of dimensional instability in a way that radically differs from traditional approaches aiming at providing a press belt which is dimensionally stable in itself. According to the invention, this problem is now instead solved by substantially preventing the press belt, which may be more or less dimensionally stable, from being stretched, by means of the reinforcing belt arranged on the outside of the press belt. With the inventive arrangement, the separate press and reinforcing belts will in operation together behave in all essential aspects as a reinforced press belt having an increased modulus of elasticity, at least in its running direction. This inherently means that the reinforcing belt has a greater modulus of elasticity than the press belt.

According to a particularly preferred embodiment of the invention, the reinforcing belt, when enclosingly mounted around the press belt in frictional engagement therewith, is prestressed, at least in its running direction, in such a manner as to act as a "corset" around the press belt. The tensile forces which in prior art shoe presses cause stretching of the press belt in the running direction thereof, must according to this embodiment of the invention overcome the prestress of the reinforcing belt, before any stretching can occur in the running direction. If nonetheless limited stretching occurs in the running direction, then this requires simultaneous and equally great stretching of both the press belt and the reinforcing belt. According to this embodiment of the invention, it is the above-mentioned prestress that entirely, or at least partly, produces the frictional engagement between the reinforcing belt and the press belt.

Advantageously, such a prestress in the reinforcing belt can be achieved by shrinking it on to the press belt. In the case of a shoe press of the short-belt type, it is convenient, during the shrinkage process, to apply a radially outwardly directed pressure (oil and/or air pressure) to the inner side of the press belt to prevent this from collapsing radially inwardly as a result of the increased radial, inwardly directed pressure exerted by the shrunk-on reinforcing belt. This can be achieved by maintaining, during the shrinkage process, a relatively low internal pressure in the non-rotating, cylindrical element, which pressure, after completed shrinkage, is raised to normal operational level. A similar outwardly directed pressure can also be used for bringing about the frictional engagement described above.

In a shoe press of the short-belt type, it is possible to provide a prestress in the reinforcing belt, both in the running direction thereof and transversally of this running direction. This can also be achieved by shrinkage of the reinforcing belt.

The inventive reinforcing belt thus lessens the requirement that the press belt must be strong and dimensionally stable. It is therefore possible to use a press belt of reduced strength entailing lower manufacturing costs. It is quite conceivable, for instance, to completely dispose of the base weave in existing press belts coated with plastic layers.

According to a preferred embodiment of the invention, a reinforcing belt is chosen which is substantially incompressible and has an internal pore volume for receiving water pressed out in the press from a paper web or the like, especially through an intermediate press felt. To this end, the reinforcing belt may be manufactured from a wire cloth, suitably of monofilament yarn. According to that stated above, it is then possible to choose a shrinkage yarn to permit shrinking the reinforcing belt on to the press belt.

It is however also conceivable to use a non-shrinking reinforcing belt, e.g. a reinforcing belt made of metal, such as a metal wire.

Further, the reinforcing belt according to the invention need not necessarily engage the press belt directly, but e.g. a wire cloth or other means may be interposed therebetween. Moreover, it is also conceivable to use several superposed reinforcing belts.

If a wire cloth is used as reinforcing belt, it is possible to choose a wire cloth having a monoplanar outer surface with may directly engage the paper web without any intermediate press felt.

According to the invention, it is possible to modify a shoe press in an existing papermaking machine or the like by means of a reinforcing belt of the above-related type in a simple manner and at a low cost, without necessitating the mounting of additional guide rollers.

Other preferred embodiments of the invention are stated in the claims.

BRIEF DESCRIPTION OF THE DRAWINGS

The invention will now be described in more detail in two embodiments with reference to the accompanying drawings.

DESCRIPTION OF PREFERRED EMBODIMENTS

Figure 1:
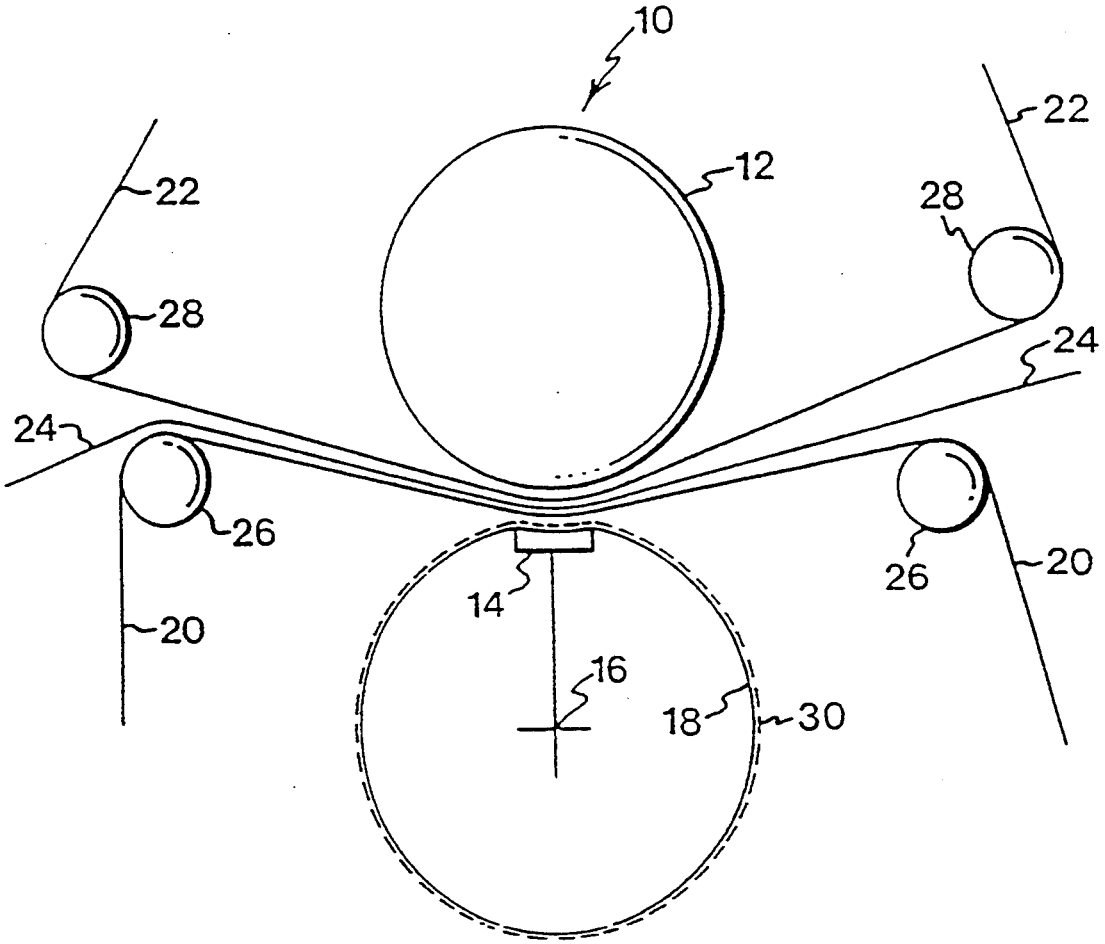
FIG. 1 is a schematic cross-sectional view of a shoe press of the short-belt type provided with a reinforcing belt according to the invention.

FIG. 1 shows the main parts of a short-belt type shoe press generally designated 10, which forms part of the press section of a papermaking machine or the like. The shoe press 10 comprises in a known manner a rotary, cylindrical upper roll 12 and a substantially stationary pressure shoe 14 integrated in a cylindrical circumference of a non-rotating, cylindrical element (not shown), having its centre at 16. The shoe 14 has an arcuate pressure surface which is facing the upper roll 12 and has a radius of curvature corresponding to the radius of the roll. The shoe press 10 further comprises in conventional manner a press casing in the form of an endless press belt 18, whose length is substantially equal to the circumference of the outer peripheral surface of the cylindrical element. In operation, the press belt 18 runs around the cylindrical element and over the pressure surface of the shoe 14 in the press nip between the upper roll 12 and the shoe 14. It should be emphasised that the term "endless press belt" as used herein should be interpreted also to include press belts having seams.

Reference numerals 20 and 22 designate two press felts which, in the press nip, run on each side of a paper web 24, whence water is to be removed. The press felts 20 and 22 run over guide rollers 26 and 28, respectively.

One or more oil ducts conduct in a known manner pressurised oil up to the pressure shoe and through internal passageways opening at the pressure surface of the shoe. The oil forms a friction-reducing oil film for promoting the sliding movement of the press belt 18 over the stationary shoe 14.

In FIG. 1, the shoe press 10 further has two terminal sealing devices (not shown), one at each end of the cylindrical element, which are connected to the axial end edges of the press belt 18 and serve to maintain the oil enclosed in a closed space. During operation, these sealing devices rotate together with the press belt relative to the cylindrical element.

The press belt 18 may be made e.g. from a base weave provided on its inner surface with a smooth, oiltight layer of plastic. Any type of conventional press belts for shoe presses can be used. However, the invention allows for completely new designs of the press belt 18, as described above.

The operation of the parts described above and of other conventional parts of a shoe press of the short-belt type shown in FIG. 1 is well-known to those skilled in the art and, Therefore, will not be described in more detail here.

According to the invention, the shoe press of FIG. 1 is equipped with a separate, endless reinforcing belt 30 which, for greater clarity, is schematically illustrated in the Figure by a dashed line. The reinforcing belt 30 encloses and is in frictional engagement with the press belt 18 throughout the entire length thereof, and so the two belts 18, 30 run Jointly when in operation without any relative sliding motion.

For the reinforcing belt 30 in FIG. 1 is preferably chosen an initially shrinkable, substantially incompressible textile product, such as a fabric of monofilament thread. A practical way of mounting such a reinforcing belt 30 is, after the press belt 18 and the reinforcing belt have been applied on the cylindrical element, to initially use a low internal pressure to maintain the press belt 18 under a certain tension while the reinforcing belt 30 is shrunk on to the press belt 18 into frictional engagement therewith. After completed shrinkage, the internal pressure can be raised to normal operational level. In this manner, the reinforcing belt 30 can be brought into an even stronger frictional engagement than if the internal pressure is maintained relatively high already during the shrinkage process.

By the tensile forces produced in the reinforcing belt 30 in connection with the shrinkage, the reinforcing belt will act as a corset around the press belt 18 located inside, this yielding the above-reported advantages. In addition, any unevenesses or variations in the thickness of the press belt 18 will be evened out or eliminated by the reinforcing belt 30.

In the shoe press 10 of the short-belt type in FIG. 1, the reinforcing belt 30 is preferably cut at its two end edges to the same width as the press belt 18 and is attached, like the press belt, to the above-mentioned terminal seals which during operation are rotating together with the press belt 18. Consequently, the reinforcing belt 30 opposes any movement of the terminal sealing devices away from each other as a result of axial stretching of the press belt 18, i.e. the combination of the reinforcing belt 30 and the press belt 18 will in all essential aspects behave as a reinforced press belt having an increased modulus of elasticity, not only in its running direction but also transversally thereof.

Alternatively, the reinforcing belt 30 may be cut to a smaller width than the press belt 18.

Figure 2:
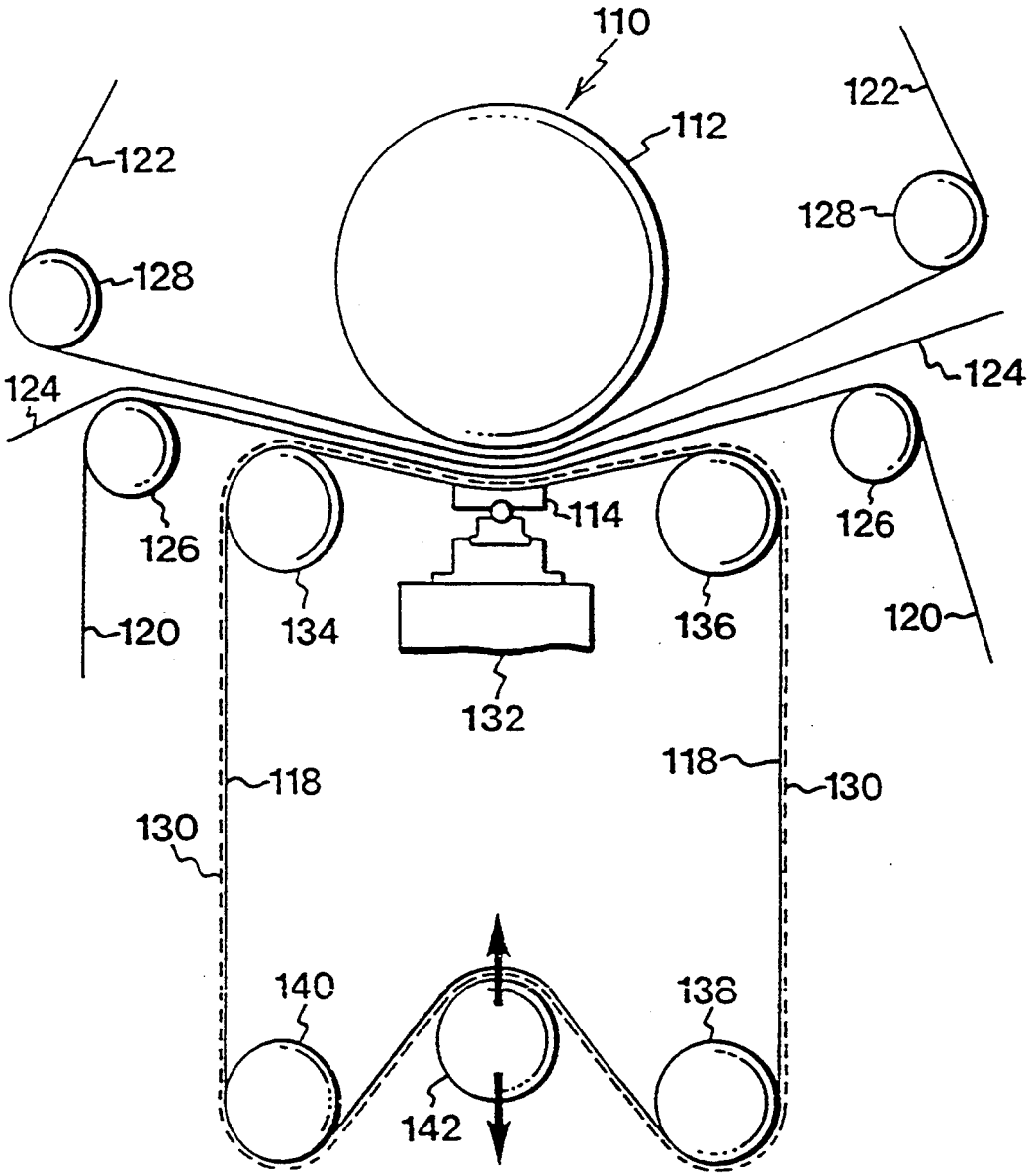
FIG. 2 is a schematic cross-sectional view of a shoe press of the long-belt type provided with a reinforcing belt according to the invention.

FIG. 2 shows the main parts in a shoe press of the long-belt type, generally designated 110, which forms part of the press section in a papermaking machine or the like. For greater simplicity, like reference numerals are used in respect of the shoe press in FIG. 2 for like parts in FIGS. 1 and 2, however with 100 added to the reference numerals in FIG. 2.

The non-rotating, cylindrical element in the shoe press 10 of FIG. 1 is not used in the shoe press 110 of FIG. 2. Instead, a pressure shoe 114 in FIG. 2 is carried by a supporting beam 132 extended in the cross machine direction below a press roll 110. According to conventional technique, the mounting of the pressure shoe 114 on the beam 132 can be performed in many different ways and requires no detailed description here.

Reference numerals 120 and 122 designate two press felts which, in the press nip, each run on one side of a paper web 124, from which water is to be removed. The press felts 120 and 122 pass over guide rollers 126 and 128, respectively.

An endless press belt 118 and a reinforcing belt 130, schematically illustrated by a dashed line and enclosing the press belt, run jointly in the embodiment of FIG. 2 in an endless path defined by number of guide rollers 134, 136, 138, 140 and 142. The roller 142 between the rollers 138 and 140 serves as a tensioning roller, as indicated by arrows. By means of the roller 142, the combined press belt 118 and reinforcing belt 130 can thus be distended in their running direction to the required extent.

The frictional engagement, characteristic of the invention, which is provided between the reinforcing belt 130 and the press belt 118 can also be achieved by the mere tension produced by the tensioning roller 142. However, for achieving the desired frictional engagement it is preferred to resort to a shrinkage process, as described above with respect to the embodiment of FIG. 1. In such a case, the tensioning force of the roller 142 can be set at a lower value during the shrinkage process and, after completed shrinkage, again be raised to normal operational level.

As in FIG. 1, the embodiment of FIG. 2 preferably uses a reinforcing belt 130 having a substantially incompressible, internal open pore volume for receiving water pressed out of the web 124, preferably a textile product, e.g. in the form of a fabric of monofilament thread. Thus, in the case of a shoe press of the long-belt type, the invention also confers the advantage that no separate guide roller system need be provided for a separate dewatering belt, as described in the above-mentioned JP 63-247061. This is a major advantage, since it is desirable in the art to be able to supplement existing shoe presses of the long belt type with a dewatering-promoting belt, but it has hitherto been considered too expensive, and in many cases even impossible because of the lack of space in the machine, to subsequently mount the required guide rollers for such a supplementary dewatering belt. By the shoe press according to the invention, the need of such a separate guide roller system is overcome.

Finally, it should be mentioned that, despite the designations "short- and long-belt types" as used herein, the press belt 18 in a shoe press 10 of the short-belt type may in actual practice be of the same length as or even longer than the press belt 118 in a shoe press 110 of the long-belt type.

Although the invention has now been described with reference to two illustrative embodiments, it is understood that it is not restricted thereto, but may be modified in several different ways within the scope of the accompanying claims.

What is claimed is:

1. A press for a press section in a papermaking machine, said press comprising a rotary press roll; a substantially stationary pressure shoe; a press belt which runs in an endless path around said pressure shoe between said pressure shoe and said press roll and which has a substantially impermeable inner surface facing said pressure shoe; and a separate, endless reinforcing belt which encloses the press belt and which, by only frictional engagement over an entire length of the press belt, runs jointly therewith in said endless path said reinforcing belt having a greater modulus of elasticity than said press belt so as to inhibit stretching of said press belt along the entire length thereof, and wherein said reinforcing belt is prestressed, at least in its running direction, over the press belt.

2. A press as claimed in claim 1, wherein said reinforcing belt is prestressed, both in its running direction and transversally of its running direction, over the press belt.

3. A press as claimed in claim 1, wherein said reinforcing belt has been shrunk on to the press belt in order to achieve the prestress.

4. A press as claimed in claim 1, wherein said reinforcing belt has a substantially incompressible, internal pore volume for receiving water pressed out in the press.

5. A press as claimed in claim 4, wherein said reinforcing belt is a textile product.

6. A press as claimed in claim 5, wherein said textile product is a woven fabric of monofilament thread.

7. A press as claimed in claim 1, wherein said press comprises two terminal sealing means, each of which is sealingly connected to a respective end edge of the press belt and wherein said terminal sealing means are also each connected to one end edge of the reinforcing belt.

8. A method for modifying a press for a press section of a papermaking machine, said press comprising a rotary press roll; a substantially stationary pressure shoe; and a press belt running in an endless path around said pressure shoe between said pressure shoe and said press roll and having a substantially impermeable inner surface facing the pressure shoe, wherein said method comprises the step of enclosing the press belt with a separate, endless reinforcing belt which, by only frictional engagement over an entire length of the press belt, runs jointly therewith in said endless path, said reinforcing belt having a greater modulus of elasticity than said press belt so as to inhibit stretching of said press belt along the entire length thereof, and further comprising the step of providing a prestress in the reinforcing belt, at least in a running direction thereof.

9. A method as claimed in claim 8, further comprising the step of providing a prestress in the reinforcing belt both in a running direction thereof and transversally of said running direction.

10. A method as claimed in claim 8, wherein said reinforcing belt is shrunk on to the press belt in order to provide the prestress.

11. A method as claimed in claim 10, wherein the press belt is held distended during said shrinkage by a tensioning force below an operating value, and wherein said tensioning force is increased to said operating value after completion of said shrinkage.

* * * * *